United States Patent [19]

Kordas, Jr. et al.

[11] 4,158,926

[45] Jun. 26, 1979

[54] TRIGGER SYSTEM FOR BLACK POWDER RIFLE

[75] Inventors: Martin W. Kordas, Jr., Huntsville; Dale L. Rose, South Ogden, both of Utah

[73] Assignee: Browning Arms Company, Morgan, Utah

[21] Appl. No.: 869,820

[22] Filed: Jan. 16, 1978

[51] Int. Cl.[2] ..... F41C 19/00

[52] U.S. Cl. ..... 42/69 R

[58] Field of Search ..... 42/69 R, 51

[56] References Cited

U.S. PATENT DOCUMENTS

| | | | |
|---|---|---|---|
| 698,440 | 4/1902 | Brown | 42/69 R |
| 814,584 | 3/1906 | Brown | 42/69 R |
| 852,942 | 5/1907 | Fisher | 42/69 R |
| 3,577,667 | 5/1971 | Kern et al. | 42/69 R |

*Primary Examiner*—Charles T. Jordan

*Attorney, Agent, or Firm*—Trask & Britt

[57] ABSTRACT

A trigger for a side lock black powder rifle includes an upper ramp surface operating against a spring biased roller. The trigger has a "set" position wherein the spring force operates through the roller against the sear lever of the lock mechanism of the rifle and a "stiff" position wherein the spring force is added to the force required against the sear.

4 Claims, 6 Drawing Figures

TRIGGER SYSTEM FOR BLACK POWDER RIFLE

BACKGROUND OF THE INVENTION

1. Field

This invention relates to trigger systems for black powder rifles. It is specifically concerned with the class of trigger systems known as "single set," and provides such a system specifically suitable for use in side lock black powder rifles.

2. State of the Art

Back lock and side lock mechanisms of various types for black powder rifles are known. Traditionally, back lock mechanisms have been used only on repeating arms, when other structures, such as a cylinder or "harmonica" sliding magazine, was present in the receiver of the arm. Generally, side lock constructions are preferable and are exclusively used in single shot black powder rifles. The preferred side lock mechanisms used in black powder rifles of present day construction are substantially similar to the traditional side lock mechanism of the Hawken rifle.

The trigger assembly from the Hawken rifle is of the "double set" class and includes two triggers. The rear trigger does not actually fire the rifle but functions to "set" the front trigger for a light or "hair" trigger feel. When a more conventional ("stiff") or single stage trigger is desired the front trigger is pulled without first pulling the second or rear trigger. The single stage mode of operation is much faster and is usually preferred for field use such as hunting.

The use of two triggers for a double set firing system is disadvantageous because of the time required for pulling both triggers and because of the dangers and confusion inherent with such systems.

SUMMARY OF THE INVENTION

According to the present invention, a single trigger is provided in association with a lock mechanism, and is adapted to function selectively in either a "stiff" trigger mode or as a "set" trigger. The mode of operation of the trigger is determined by a simple positioning of the trigger itself. When the hammer is cocked, the trigger is normally in its "stiff" trigger mode and can be pulled to fire the gun. If a "set" mode is desired, the trigger is urged forward with finger pressure, which movement places the trigger mechanism in "set" position for "hair" firing. The trigger may be set back to the "stiff" mode without danger of discharging the firearm. The mode selection is accomplished by pivoting the trigger on an axle to adjust the position of a ranged surface atop the trigger with respect to a spring-biased roller. In this fashion, the spring pressure may be caused to either assist or resist tripping of the arm's sear lever.

BRIEF DESCRIPTION OF THE DRAWINGS

In the drawings, which illustrate the best mode presently contemplated for carrying out the invention.

DESCRIPTION OF THE ILLUSTRATED EMBODIMENT

Figure 1:
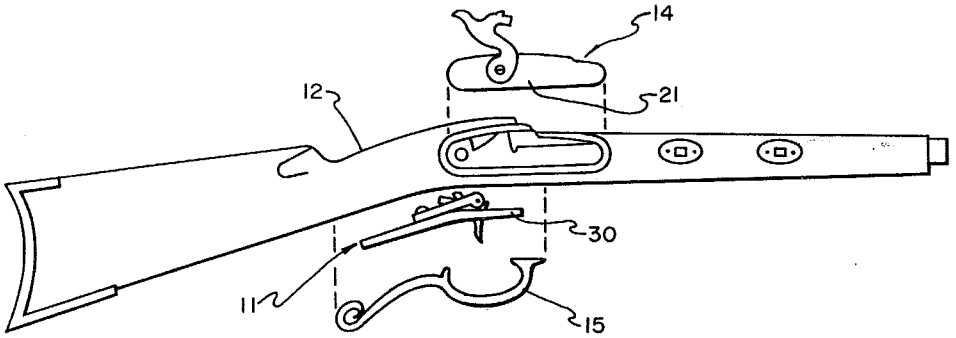
FIG. 1 is a partially exploded view showing the placement of the trigger mechanism of this invention with a side lock mechanism within the stock of a black powder rifle.

As may be seen from FIG. 1, a trigger assembly 11 of this invention is installed in more or less conventional fashion in a gun stock 12. A side percussion lock assembly 14 and trigger guard 15, both of conventional design, are also mounted to the stock 12.

Figure 2:
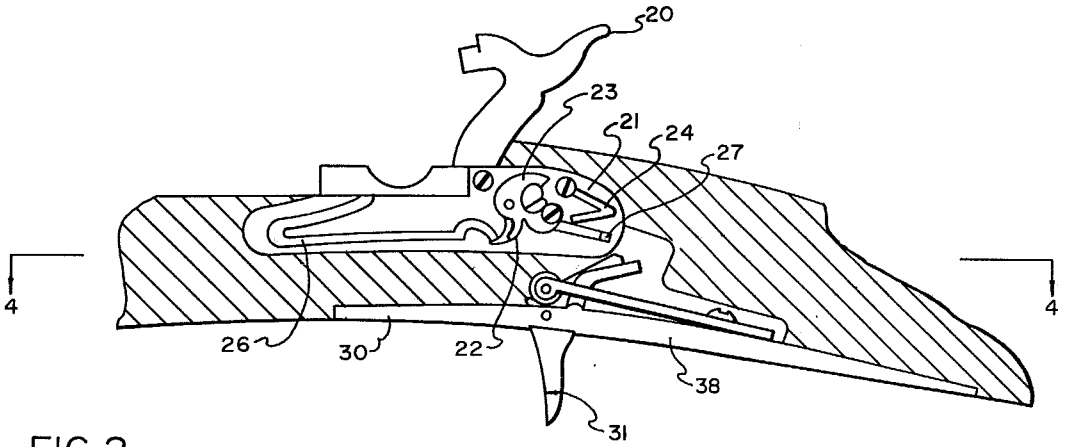
FIG. 2 shows the side lock and trigger mechanisms of FIG. 1 installed in the stock, rotated laterally 180°, and with the hammer in cocked position and the trigger in its "stiff" condition.
Figure 3:
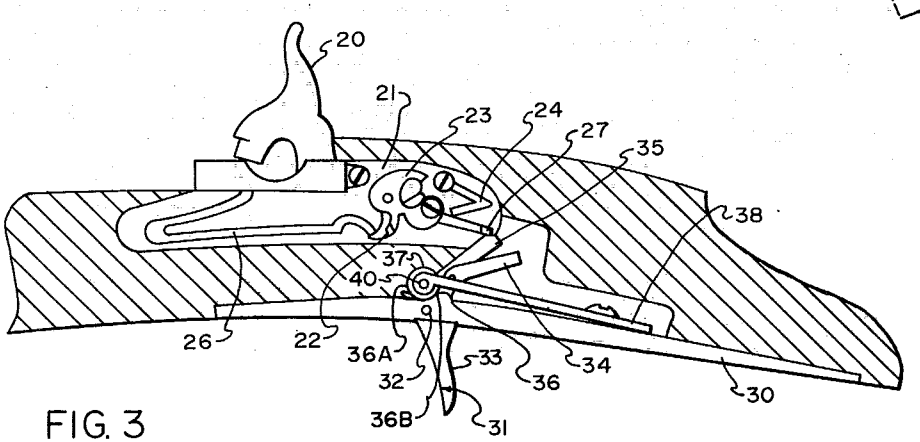
FIG. 3 is similar to FIG. 2 but shows the mechanisms with the trigger pulled and the hammer in fired position.
Figure 4:
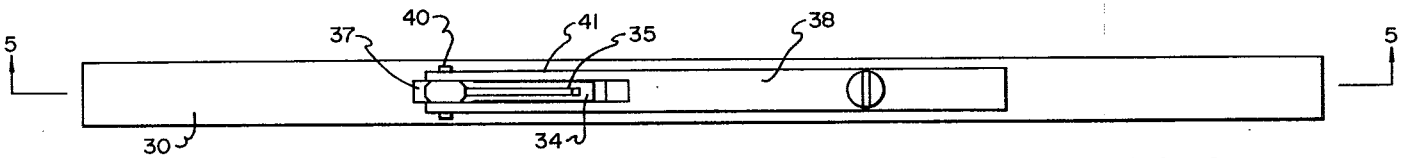
FIG. 4 shows a portion of the trigger mechanism rotated 90° from the top with respect to FIG. 3.

FIGS. 2 and 3 illustrate the interrelationship of the components of the trigger assembly 11 and percussion lock assembly 14. The percussion lock includes a hammer 20 pivotally mounted to a lock plate 21. A sear 22 is carried by a bridle 23 and acts against a sear spring 24. When the hammer is pulled back into cocked position (FIG. 2), the sear 22 is locked by a tumbler, thereby storing energy in the main spring 26. The sear 22 is disengaged from the tumbler (not visible) by trigger-induced force acting upon the sear lever 27, as best seen in FIG. 3.

Figure 5:
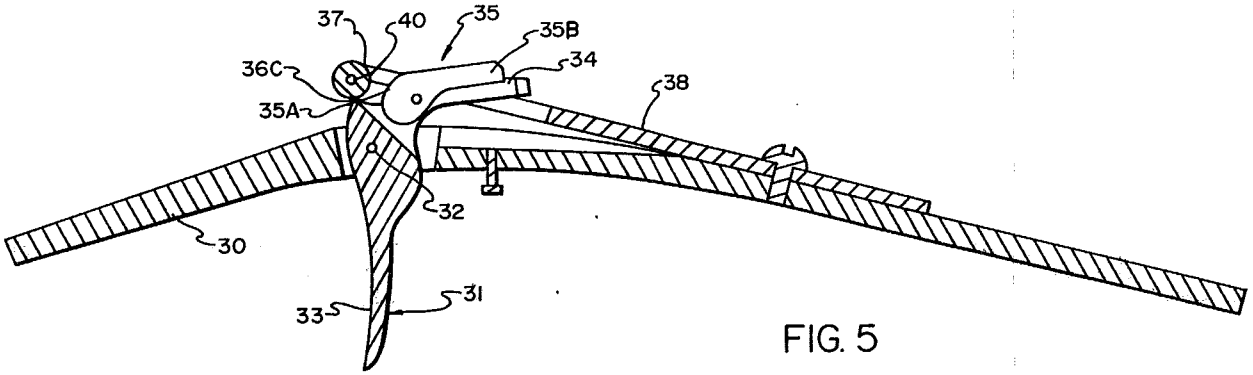
FIG. 5 shows the mechanism of FIG. 4 rotated to the same position as FIG. 3 and with the trigger in "set" or "hair trigger" condition.

The trigger assembly 11 includes a trigger plate 30 with a trigger 31 pivotally mounted on an axle 32. The trigger 31 includes a finger-actuated arm 33 depending from the axle 32 and a bifurcated sear-actuating arm 34 extending from the axle 32 opposite the arm 33. A supplemental sear actuator 35 is pivotally mounted within the bifurcated arm 34, as best shown by FIG. 5. The upper surface of the trigger 31 is specially configurated with a ramped surface 36 to receive a roller 37 which is biased by a leaf spring 38 downward toward the trigger plate 30. The roller 37 turns on an axle 40 at the distal end of the spring 38 within a bifurcated extension 41.

In the normal, or "stiff," trigger mode, after the hammer is cocked (FIG. 2), the lock mechanism is released by merely pulling the trigger arm 33, thereby pivoting the trigger 31 to bring the sear-activating arm 34 up thereby urging the strut 35 into contact with the sear lever 27. Pivoting of the trigger 31 in this mode is against the rolling frictional force of the roller 37 and strut 35. As the trigger 31 pivots, the front surface 35A of the strut 35 is forced into contact with the roller 37 causing the main portion of this element 35B to lift against the sear lever 27. In this fashion, the sear-releasing action of the trigger is amplified so that a relatively short pull on the trigger arm 33 is translated into an adequate lift of the sear lever 27 to ensure proper functioning of the percussion lock 14.

The "hair" trigger mode of operation is illustrated by FIG. 5 which shows the trigger pivoted (trigger arm 33 pushed forward) so that the force of the spring 38 exerts a torque (clockwise) opposite to the direction of trigger pull needed to discharge the firearm (counterclockwise). The roller 37 is lifted by a camming action of the forward portion 36A of the surface 36 as the trigger arm 33 is pushed forward. When the trigger is "set" the roller 37 rests beyond the cam peak 36C of the ramped surface 36. When the trigger is pulled, the roller 37 travels across the contoured surface 36 and down toward the trigger plate 30, thereby releasing energy stored by the spring 38. The "set" trigger is in a metastable state so that a very slight touch of the trigger arm 33 effects a rapid pivoting of the trigger 31. The force of the spring 38 causes the strut 35 to impact with considerable momentum against the roller 37. The element 35B thus strikes sear lever 27 with like force and momentum to discharge the firearm.

Although the trigger mechanism is described in connection with side lock construction, it can, with some modifications, be used in conjunction with back lock constructions. Such constructions are generally of interest only with repeating arms, however, and repeaters are presently of little interest to black powder enthusiasts. The drawings illustrate the spring roller 37 mounted on an axle 40 within a bifurcated end 41 of the spring 38. The bifurcated end 41 straddles the trigger 31. It should be understood that other constructions are within contemplation. Reference herein to details of the illustrated embodiments is not intended to restrict the scope of the claims, which themselves recite those details regarded as essential to the invention.

Figure 6:
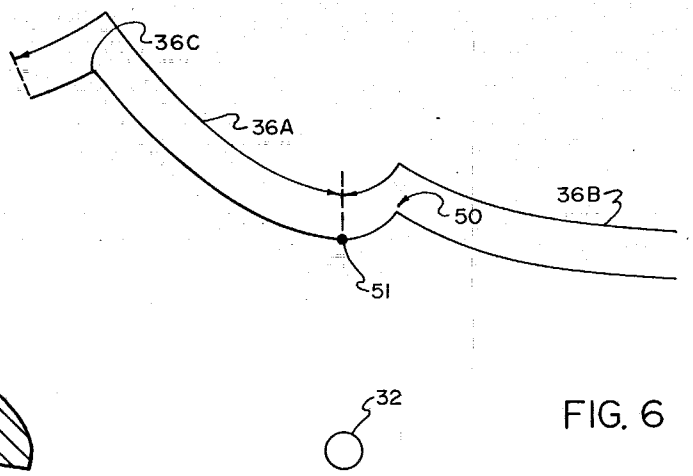
FIG. 6 is a diagrammatic representation of a trigger surface.

Referring to FIG. 6, the contoured surface 36 may be regarded as being divided by an inflection point 50 on the surface 36. A dwell point 51 is located in the vicinity of the inflection point but towards the peak 36C. A first portion 36A of the ramped surface extends from the dwell point 51 to and beyond the peak 36C, while a second portion 36B extends from this point in the opposite direction. When the trigger 31 is in "set" mode, the roller 37 is in contact with the first portion 36A beyond the peak 36C and the spring 38 has stored sufficient energy that when the trigger 31 is pivoted to move the peak 36C beyond the roller 37, the normal force of the roller bearing on surface 36 causes the trigger 31 to pivot until the roller 37 has traversed the entire segments 36A and 36B. Cocking the gun causes the sear lever 27 to contact strut member 35B which in turn urges the strut member 35A into contact with roller 37 and forces the trigger 31 to rotate until the dwell point 51 comes to rest in contact with roller 37. In this position, there is no tendency for the strut 35 or sear-activating arm 34 to discharge the gun. The trigger is then in the "stiff" mode. Pulling the trigger rotates the segment 36B across the roller 37, reversing the action of the strut 35 to discharge the gun. Shaping of the ramp contour can also affect the "stiffness" or "fineness" of the trigger. A contour which tends to lift the roller 37 acts against the spring 38, while a contour that permits the roller 37 to move towards the trigger plate 30 reduces the spring force acting against the surface 36.

The surface 36 may be contoured variously. The distance between the trigger pivot 32 and peak 36C must be sufficiently greater than the distance between this pivot 32 and the inflection point 50 to ensure discharge of the gun. The precise dimensions required depend on various factors including the strength and position of the spring 38. The segments 36A and 36B are illustrated as both concave upward so that point 50 is a true inflection point. It is recognized that the segment 36B may be concave downward. In any event, it is important that a dwell point, (a static equilibrium position) be provided at a midregion of the surface 36 to provide a "stiff" trigger setting.

We claim:

1. In a firing system for black powder rifles having a lock assembly mounted within a gun stock with a sear adapted to hold a hammer in cocked condition and a sear lever connected to said sear and constituting means for releasing said hammer from cocked position when said sear lever is actuated, the improvement comprising:

a trigger assembly mounted within said gun stock and including:

a trigger plate on the under surface of said gun stock, said plate having a bifurcated portion;

a trigger pivotally mounted within said bifurcated portion of said trigger plate on an axle transverse said bifurcated portion, said trigger including a finger-actuated arm depending from said axle, a sear-actuating arm extending from said axle opposite said finger-actuated arm, and a ramped upper surface;

a flat leaf spring anchored to said trigger plate with a bifurcated portion straddling said sear-actuating arm of said trigger and carrying a spring roller biased by said spring against said ramped surface;

said ramped surface including a first portion extending from the said axle away from the sear-actuating arm and including a peak, a second portion extending from said axle toward said sear-actuating arm and a dwell point in a midregion so that the trigger may be pivoted to a first (set) position with the spring roller in contact with said first segment beyond the peak or to a second (stiff) position with the spring roller in contact with said dwell point.

2. The improvement of claim 1 wherein the first portion of said ramped surface is contoured to urge said spring roller away from said trigger plate when said trigger is pivoted to said first (set) position thereby storing energy in said flat leaf spring.

3. The improvement of claim 1 wherein said sear-activating arm is bifurcated and a strut is pivotally mounted on an axle between the opposing sides of said bifurcated arm.

4. The improvement of claim 3 wherein said strut has a first arm adapted to contact said spring roller when said trigger is pivoted and a second arm arranged to strike said sear lever in response to contact of said first arm by said roller.

* * * * *